US008336441B1

(12) United States Patent
Javorsky

(10) Patent No.: US 8,336,441 B1
(45) Date of Patent: Dec. 25, 2012

(54) ROTATABLE GUN MOUNT

(75) Inventor: David Javorsky, Dingmans Ferry, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 181 days.

(21) Appl. No.: 12/949,270

(22) Filed: Nov. 18, 2010

(51) Int. Cl.
*F41A 23/00* (2006.01)
*F41A 23/24* (2006.01)
*F41A 9/79* (2006.01)

(52) U.S. Cl. ..... 89/37.03; 89/37.16; 89/37.21; 89/33.01; 89/33.1

(58) Field of Classification Search ..... 89/33.01, 89/33.1, 33.14, 33.16, 33.17, 33.2, 33.25, 89/37.01, 37.03, 37.07, 37.08, 37.11, 37.13, 89/37.16, 37.21, 38, 40.01, 40.04, 40.08, 89/40.12, 40.15, 174, 176, 197; 248/189.2, 248/220.22, 324, 298.1, 685; 73/167
See application file for complete search history.

(56) References Cited

U.S. PATENT DOCUMENTS

| | | | | | |
|---|---|---|---|---|---|
| 1,719,147 | A * | 7/1929 | Tansley | 89/33.14 |
| 1,799,283 | A * | 4/1931 | Coupland | 89/33.14 |
| 2,227,726 | A * | 1/1941 | Laddon et al. | 89/37.16 |
| 2,252,079 | A * | 8/1941 | Laddon et al. | 89/37.16 |
| 2,345,747 | A * | 4/1944 | Hake | 89/37.16 |
| 2,354,114 | A * | 7/1944 | Growald | 89/37.21 |
| 2,419,242 | A * | 4/1947 | Woodberry et al. | 193/47 |
| 4,430,922 | A * | 2/1984 | Fog et al. | 89/37.11 |
| 4,708,052 | A * | 11/1987 | Argon | 89/41.01 |
| 5,263,397 | A * | 11/1993 | Sanderson | 89/37.22 |
| 5,282,410 | A * | 2/1994 | Sanderson | 89/37.16 |
| 6,250,196 | B1 * | 6/2001 | Sanderson | 89/37.16 |
| 6,250,197 | B1 * | 6/2001 | Sanderson | 89/37.16 |
| 6,283,428 | B1 * | 9/2001 | Maples et al. | 248/282.1 |
| 6,286,411 | B1 * | 9/2001 | Sanderson | 89/37.16 |
| 6,293,179 | B1 * | 9/2001 | Sanderson | 89/37.03 |
| 6,439,098 | B1 * | 8/2002 | Dillon | 89/34 |
| 6,729,592 | B1 * | 5/2004 | Kurtts | 248/278.1 |
| 6,779,430 | B1 * | 8/2004 | Sanderson | 89/33.16 |
| 6,799,500 | B1 * | 10/2004 | Kulikowski | 89/34 |
| 7,258,055 | B1 * | 8/2007 | Javorsky | 89/37.01 |
| 7,415,790 | B1 * | 8/2008 | Ruhland et al. | 42/94 |
| 7,513,187 | B1 * | 4/2009 | Lambermont | 89/37.07 |
| 7,543,524 | B1 * | 6/2009 | Javorsky | 89/37.01 |
| 7,546,794 | B1 * | 6/2009 | Sarles et al. | 89/34 |
| 7,780,026 | B1 * | 8/2010 | Zuckerman | 220/23.4 |
| 7,963,205 | B1 * | 6/2011 | Brooks | 89/37.03 |
| 8,151,684 | B2 * | 4/2012 | Buechler et al. | 89/33.2 |
| 2006/0273125 | A1 * | 12/2006 | Bogoslofski et al. | 224/509 |
| 2009/0094769 | A1 * | 4/2009 | Wilson | 15/144.1 |

* cited by examiner

*Primary Examiner* — Bret Hayes
*Assistant Examiner* — Derrick Morgan
(74) *Attorney, Agent, or Firm* — Michael C. Sachs

(57) ABSTRACT

A gun mount for spanning an opening, such as a door or window, may include a generally tubular bar having a pivot and lock structure on one end. The bar may include a pair of slots formed on opposing sides of the bar. A locking sleeve may be slidable on the bar. A fastener may be fixed to the locking sleeve and translatable in the pair of slots in the bar. A second generally tubular bar may include a yoke at one end and a hinge assembly at another end. The yoke may be rotatably engaged with the pivot and lock structure. The pivot and lock structure may include a locking groove. A spring-loaded locking plunger may be translatably disposed in the yoke and may include a protrusion that is selectively engagable with the locking groove.

13 Claims, 20 Drawing Sheets

ROTATABLE GUN MOUNT

STATEMENT OF GOVERNMENT INTEREST

The inventions described herein may be manufactured, used and licensed by or for the U.S. Government for U.S. Government purposes.

BACKGROUND OF THE INVENTION

The invention relates to mounts for guns, such as machine guns.

A machine gun mount may be used to support and mount a machine gun. The machine gun may be, for example, an M240H machine gun. The machine gun may be mounted to or on a structure. The structure may be, for example, a helicopter, such as a CH47 Chinook helicopter. A helicopter or other structure may include doors and windows. The machine gun mount may be used to mount the machine gun at a door or window. In a CH47 Chinook helicopter, for example, machine guns may be mounted at multiple locations. The multiple locations may include a front door and a window.

Problems with known machine gun mounts have existed for approximately 50 years. One known mount includes a fixed bar that spans the opening in a doorway or window. When the fixed bar is installed across a doorway or window, personnel must either crawl under or over the fixed bar for ingress or egress. Crawling over or under the fixed bar is a major problem, especially if the personnel are dressed in full combat gear.

A need exists for a gun mount that can be easily moved so it does not block ingress or egress through an access point.

SUMMARY OF THE INVENTION

It is an object of the invention to provide a gun mount that can be easily moved so it does not block ingress or egress through an access point.

One aspect of the invention is a mount for a gun. The mount may include a generally tubular bar having a pivot and lock structure on one end. The bar may include a pair of slots formed on opposing sides of the bar. A locking sleeve may be slidable on the bar. A fastener may be fixed to the locking sleeve and translatable in the pair of slots in the bar. The mount may include a second generally tubular bar having a yoke at one end and a hinge assembly at another end. The yoke may be rotatably engaged with the pivot and lock structure.

The pivot and lock structure may include a locking groove and an angled surface having one edge at the locking groove. The angled surface may slope inwardly from the one edge toward another end of the generally tubular bar. A spring-loaded locking plunger may be translatably disposed in the yoke and may have a protrusion that is selectively engagable with the locking groove. A spring-loaded lock release may be translatably disposed in the generally tubular bar and may be engaged with the fastener. The protrusion of the locking plunger may be disengaged from the locking groove of the pivot and lock structure by translation of the spring-loaded lock release.

A pin may be disposed in openings in the yoke and the pivot and lock structure. In an unlocked position of the mount, the generally tubular bar may be rotatable around the pin. The second generally tubular bar may include a pair of slots formed therein and the spring-loaded locking plunger may include a transverse opening. The mount may further include a second fastener translatably disposed in the pair of slots in the second generally tubular bar and disposed in the transverse opening of the spring-loaded locking plunger.

A pintle socket may be fixed to the second generally tubular bar. An ammunition container may be supported by the second generally tubular bar. The mount may include a pintle and a gun cradle. The pintle may have one end disposed in the pintle socket and the other end fixed to the gun cradle.

The pivot and lock structure may include a blocker in the form of a protuberance on a side of the locking groove opposite the angled surface. As the protrusion of the locking plunger disengages from the locking groove of the pivot and lock structure, the blocker may limit the direction of rotation of the yoke with respect to the pivot and lock structure.

In one embodiment, an ammunition container may be supported by the gun cradle. The cradle-mounted ammunition container may include a mounting bracket that extends around a front wall and two side walls of the ammunition container. The ammunition container may include a cross-over compartment adjacent first and second ammunition storage compartments. The cross-over compartment may include a filler block having a transverse dimension about the same as a transverse dimension of one of the first and second ammunition storage compartments and an axial dimension about the same as one-half an axial extent of the cross-over compartment. The filler block may have a height about the same as a height of a partition between the cross-over compartment and one of the first and second ammunition storage compartments.

The mounting bracket on the cradle-mounted ammunition container may include a protruding portion that defines a gap between the front wall of the ammunition container and the protruding portion. The protruding portion of the mounting bracket may include an opening having a generally inverted U shape. A second mounting bracket may be fixed to the gun cradle and a mounting plate may be fixed to the second mounting bracket. A lug with a through-hole may be fixed to the second mounting bracket. The mounting plate may include a raised portion having a generally inverted U shape.

The cradle-supported ammunition container may be fixed to the gun cradle by inserting the mounting plate into the gap between the front wall of the ammunition container and the protruding portion of the mounting bracket such that the generally inverted U shape opening of the mounting bracket mates with the generally inverted U shape raised portion of the mounting plate. The ammunition container may be further fixed to the gun cradle by inserting a locking plunger staked to the through-hole in the lug through an opening in an ear that extends from the mounting bracket of the ammunition container.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A gun mount that spans an opening may include a swing-away feature to allow rapid ingress and egress of humans. The swing-away feature may allow a gun to be pivoted or rotated out of the opening of a door, window, or other structure. The gun mount may include multiple ammunition containers. The multiple ammunition containers may include two different ammunition containers that have a 400 ready round capacity. Prior machine gun mounts may have had only a 200 ready round capacity. The gun mount may include a spent case collection system.

The gun mount may include a cradle-mounted ammunition container. The cradle-mounted ammunition container may incorporate a compact, double stack design. The double stack design may include no internal moving parts. The double stack design may reliably feed ammunition with no internal jams. In the past, internal jams may have occurred at the belt crossover point.

Figure 1:
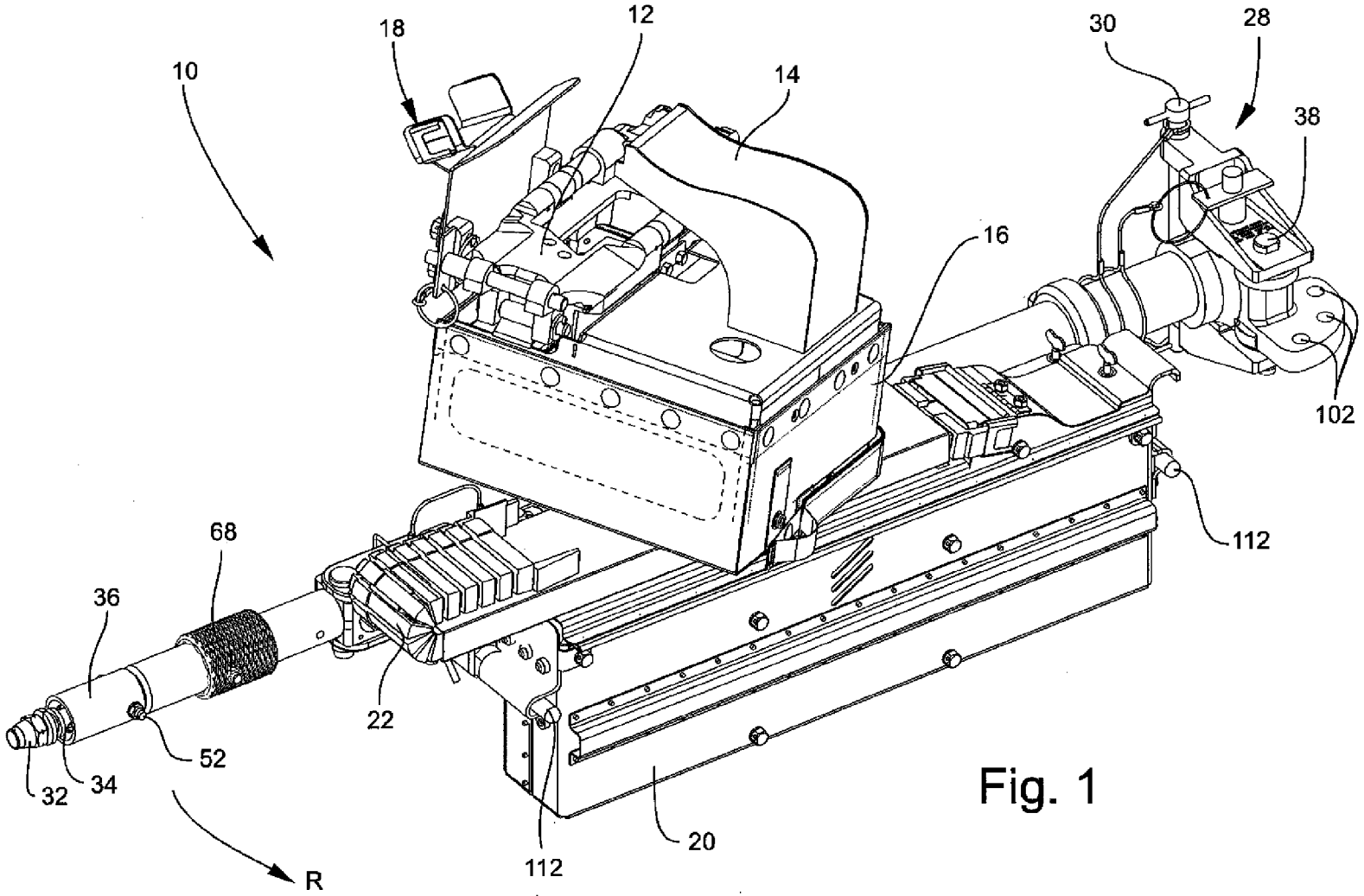
FIG. 1 is a perspective view of one embodiment of a gun mount.

FIG. 1 is a perspective view of an embodiment of a gun mount 10. Gun mount 10 may be used, for example, to mount a gun in an opening, such a door or window, in a structure. The structure to which mount 10 is fixed may be mobile or immobile. Mobile structures may include air, land, and sea vehicles. Immobile structures may include buildings, for example.

A gun (not shown) may be mounted on a gun cradle 12. One side of the gun may interact with a spent case collector 14 that leads to a spent case storage container 16. Container 16 may be supported by cradle 12. Another side of the gun may interact with a magazine feed mechanism disposed at area 18. In the embodiment of FIG. 1, a bar-mounted ammunition container 20 may supply ammunition to the gun in mount 10 via a flexible chute 22. As better seen in FIG. 2, gun cradle 12 may be fixed to a pintle 24. As is known in the art, gun cradle 12 is movable in azimuth and elevation on pintle 24. Pintle 24 may be fixed to and supported by a rotatable arm assembly 26.

Figure 3:
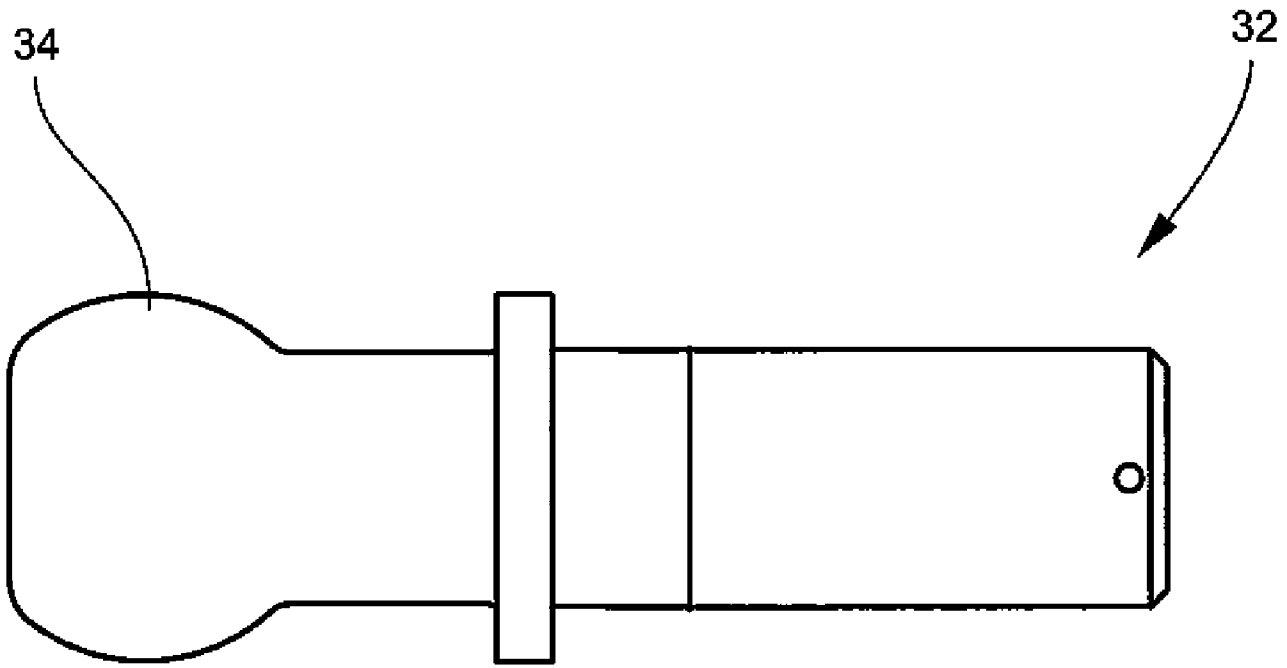
FIG. 3 is an enlarged side view of a support member for one end of the gun mount of FIG. 1.

One end of mount 10 may include a hinge assembly 28. Hinge assembly 28 may include a mounting pin 30 (FIG. 1) for fixing mount 10 to a suitable bracket located on one side of the opening in the structure. The other end of mount 10 may include a support member 32 (shown enlarged in FIG. 3) with a generally spherical end 34. Support member 32 may be fixed to a side of the opening in the structure opposite the side where hinge assembly 28 is fixed. Thus, arm assembly 26 may span across the opening in the structure.

Arm assembly 26 may include a guide bushing 36 that fits over spherical end 34 of support member 32. Spherical end 34 may be inserted into bushing 36 when mount 10 is in a locked position that spans the opening in the structure. In the unlocked position, guide bushing 36 may be moved off of spherical end 34 of support member 32 and mount 10 may be rotatable about an axis pin 38 in hinge assembly 28. In FIG. 1, mount 10 is rotatable in direction R about axis pin 38. The rotation of mount 10 about axis pin 38 allows one to remove mount 10 from the opening in the structure with relative ease.

The structure of arm assembly 26 will now be described in more detail. Arm assembly 26 (FIG. 2) may include a generally tubular bar 40 and a second generally tubular bar 42. Tubular bar 40 may include guide bushing 36 at one end and a pivot and lock structure 44 at the other end. Second tubular bar 42 may include hinge assembly 28 at one end and a yoke 46 at the other end. Yoke 46 may be rotatably engaged with pivot and lock structure 44. The rotatable joint between yoke 46 and pivot and lock structure 44 may allow bar 40 to pivot with respect to bar 42, and thereby allow a user to lock and unlock arm assembly 26.

Referring to FIGS. 4A-E, tubular bar 40 may include a pair of slots 48 formed on opposing sides of bar 40. Pivot and lock structure 44 may be fixed to one end of bar 40. The other end of bar 40 may include a transverse opening 50. Opening 50 may be used to attach guide bushing 36 (FIGS. 1 and 3) to bar 40 with a fastener 52. Pivot and lock structure 44 may include a locking groove 54 formed on an end thereof. At an edge 56 of locking groove 54, an angled surface 58 may slope inwardly. An axial channel 60 may be formed through pivot and lock structure 44 and bar 40. Channel 60 may intersect locking groove 54. A blocker 62 may be formed on the end of pivot and lock structure 44 opposite angled surface 58. Blocker 62 may be in the form of a protuberance on a side of locking groove 54 opposite angled surface 58. A safety pin opening 64 may be formed completely through pivot and lock structure 44. A sight hole 66 may be formed in pivot and lock structure 44.

Figure 7A:
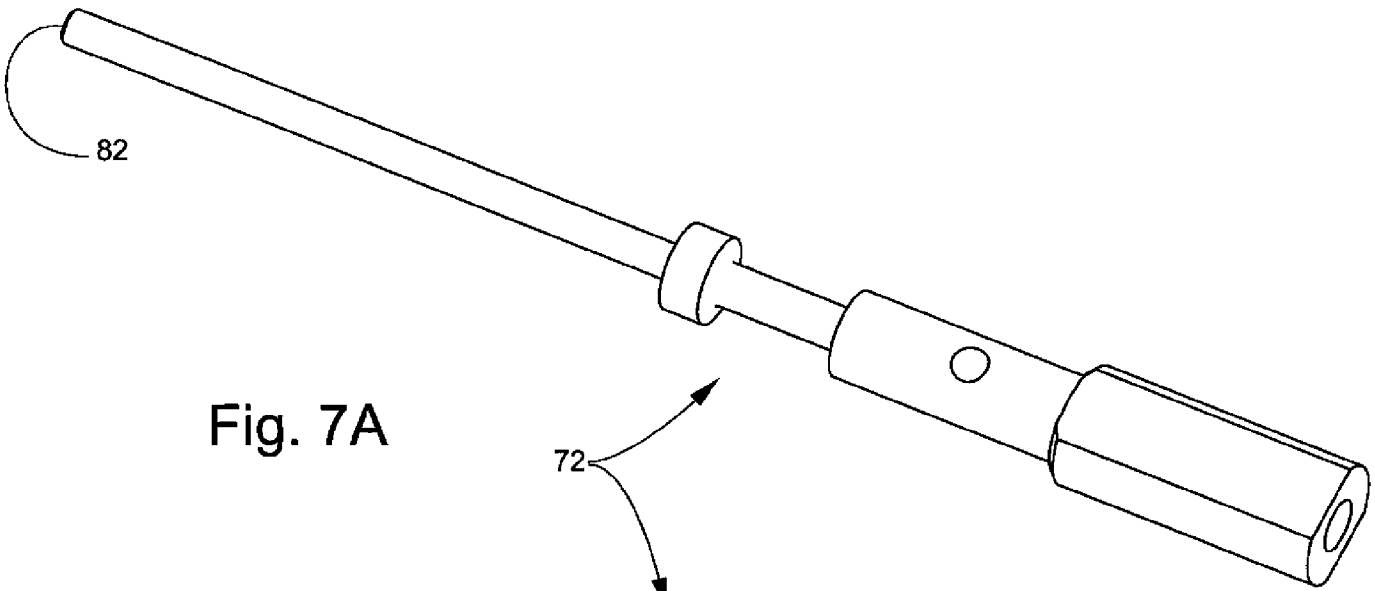
FIG. 7A is a perspective view of a lock release.
Figure 7C:
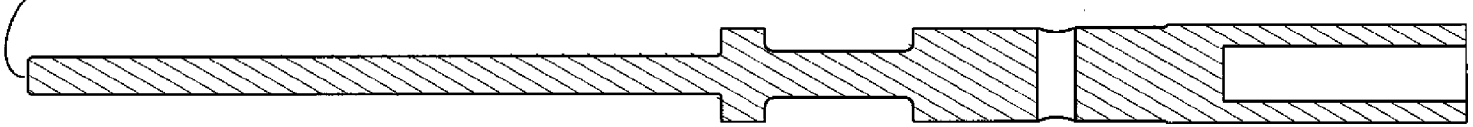
FIG. 7C is a sectional view along the line 7C-7C of FIG. 7B.
Figure 7B:
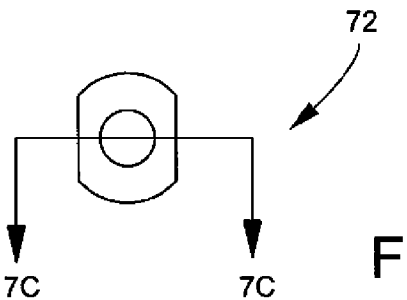
FIG. 7B is an end view of FIG. 7A.

Referring now to FIGS. 5A-5E, a locking sleeve 68 may be slidable on bar 40. A fastener 70 may be inserted transversely through locking sleeve 68 and slots 48 (FIG. 4A) in bar 40. Fastener 70 may be translatable in slots 48 in bar 40. A spring-loaded lock release 72 (shown in detail in FIGS. 7A-C) may be translatably disposed in axial channel 60 (FIGS. 4A and 4C) in pivot and lock structure 44 and bar 40. Lock release 72 may be fixed to fastener 70. Lock release 72 may include a spring 74. When locking sleeve 68 is moved to the left, as viewed in FIG. 5D, lock release 72 is also moved to the left by fastener 70 and, therefore, spring 74 may be compressed. When locking sleeve 68 is released, spring 74 may decompress and move lock release 72 back to the position shown in FIG. 5D.

Yoke 46 may be rotatably engaged with pivot and lock structure 44 via a pin 76. A spring-loaded locking plunger 78 may be translatably disposed in yoke 46. Plunger 78 may include a protrusion 80 (FIGS. 6A-6D) that is selectively engagable with locking groove 54 (FIG. 4A) of pivot and lock structure 44. In the locked position, protrusion 80 is engaged in locking groove 54 and yoke 46 cannot be rotated with respect to pivot and lock structure 44, and, consequently, tubular bar 40 cannot be rotated with respect to tubular bar 42. In the unlocked position, protrusion 80 is removed from locking groove 54 and yoke 46 may be rotated with respect to pivot and lock structure 44, and, consequently, tubular bar 40 can be rotated with respect to tubular bar 42.

Figure 4A:
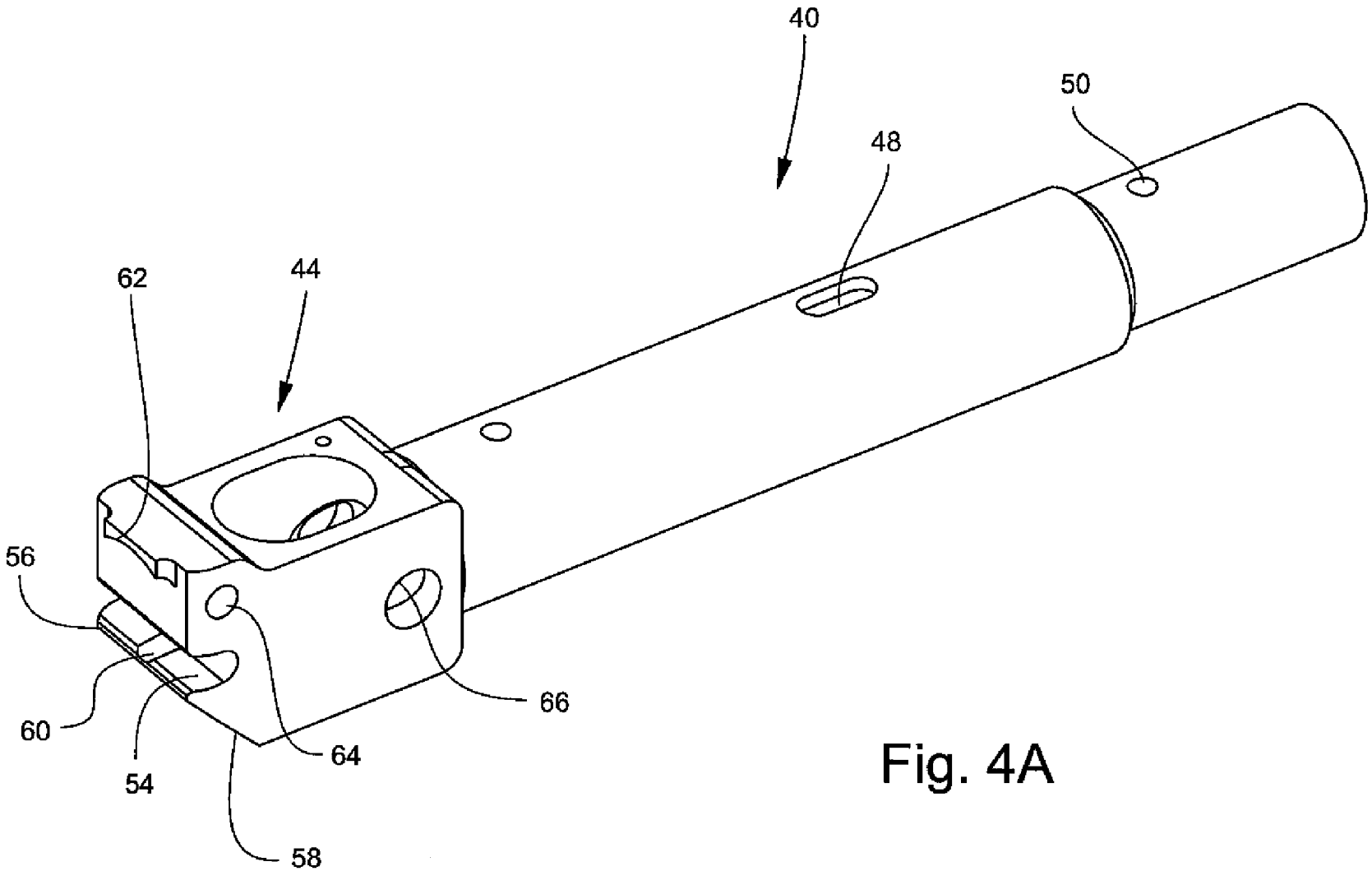
FIG. 4A is a perspective view of a tubular bar shown in FIG. 1.
Figure 4D:
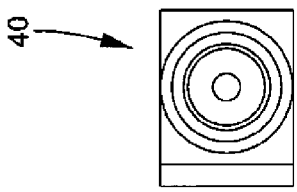
FIG. 4D is an end view of FIG. 4C.
Figure 4E:
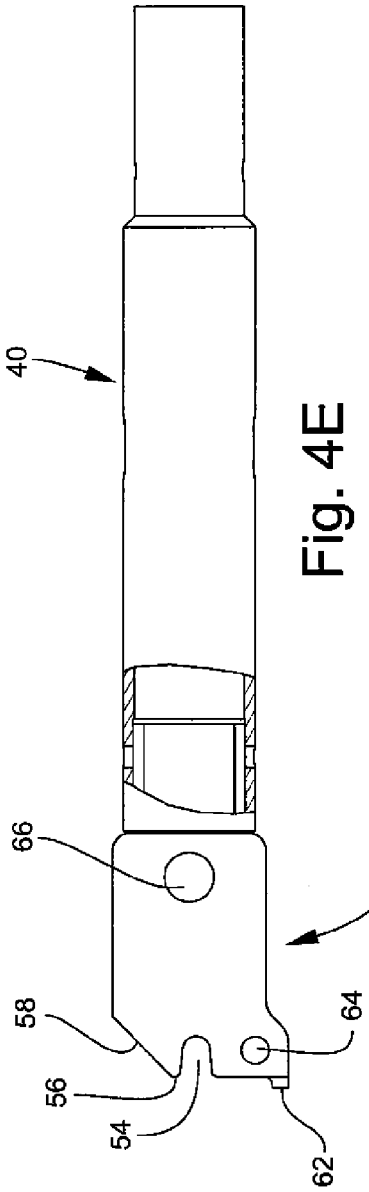
FIG. 4E is a partial sectional view taken along the line 4E-4E of FIG. 4C.
Figure 4C:
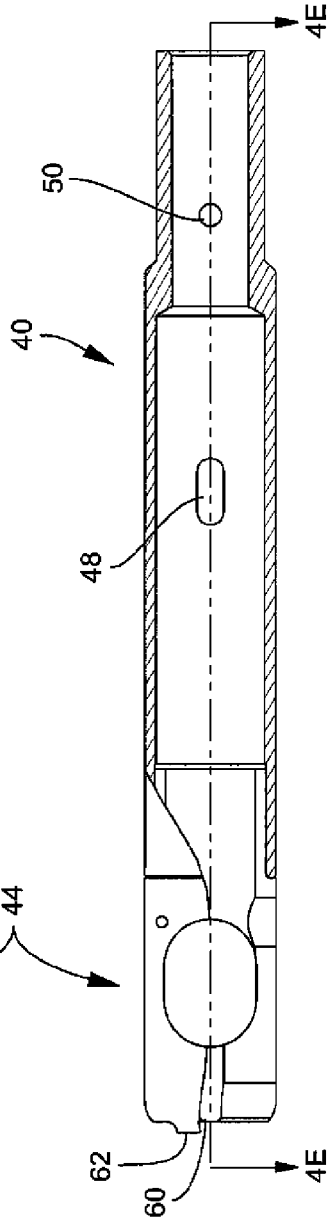
FIG. 4C is a partial sectional view taken along the line 4C-4C of FIG. 4B.
Figure 4B:
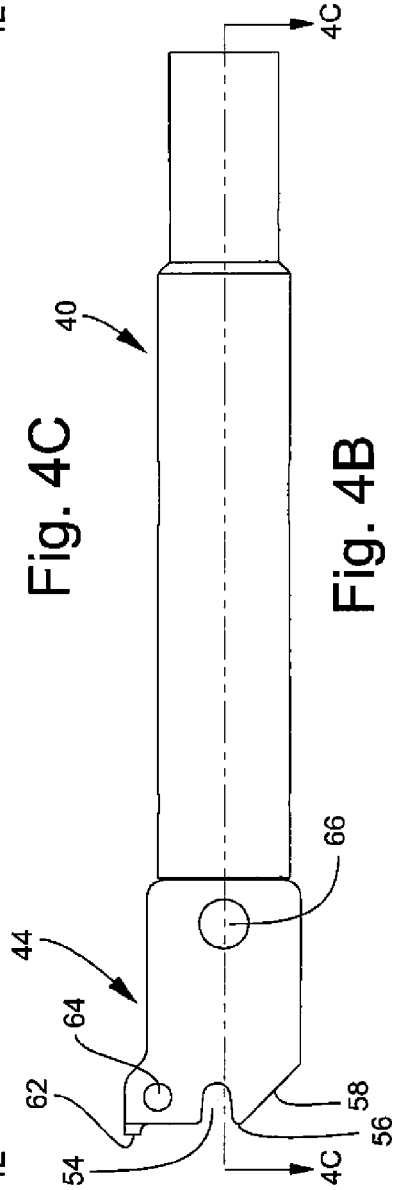
FIG. 4B is a side view of FIG. 4A.
Figure 5A:
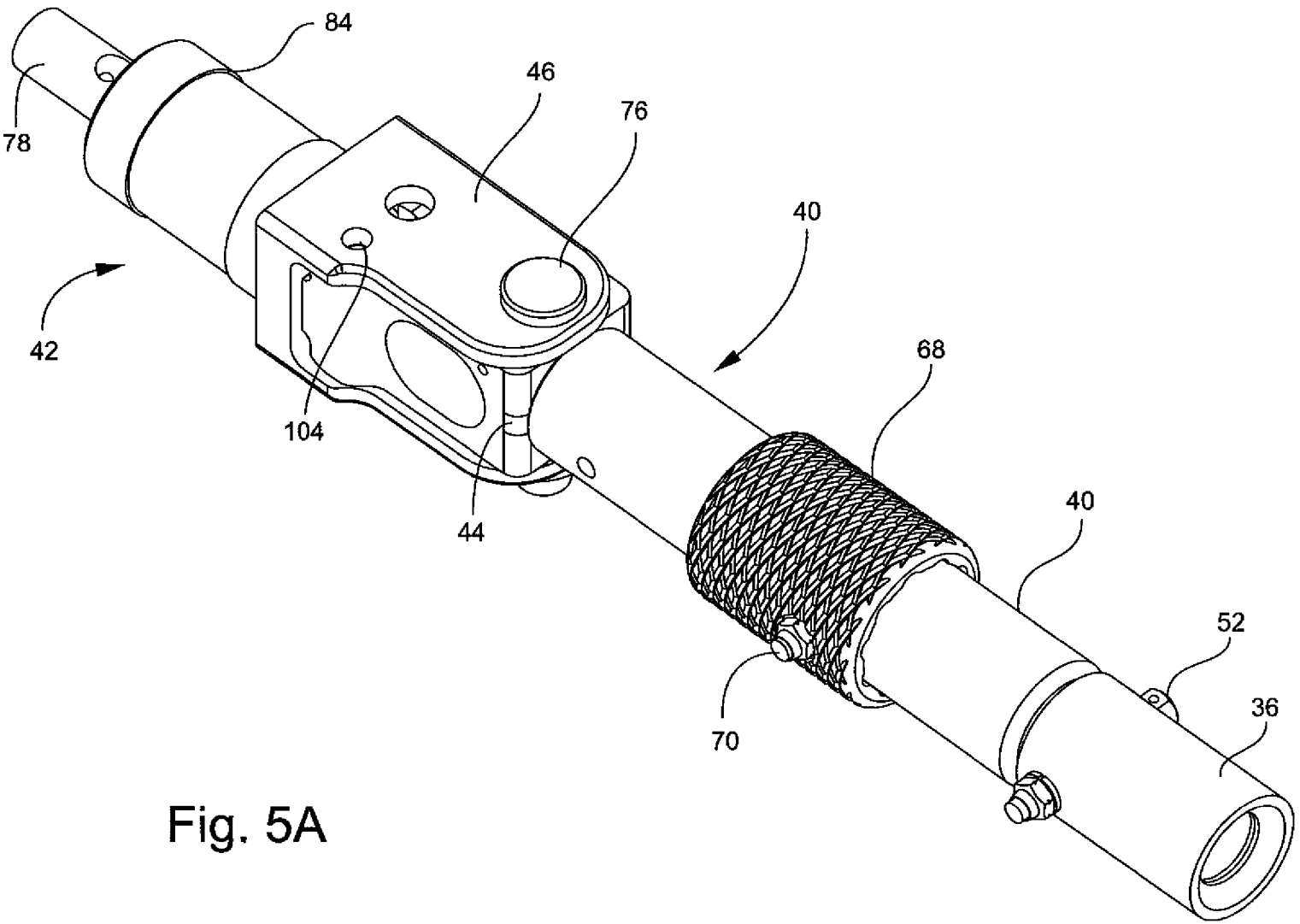
FIG. 5A is a perspective view of the connection between the yoke and the pivot and lock mechanism.
Figure 5B:
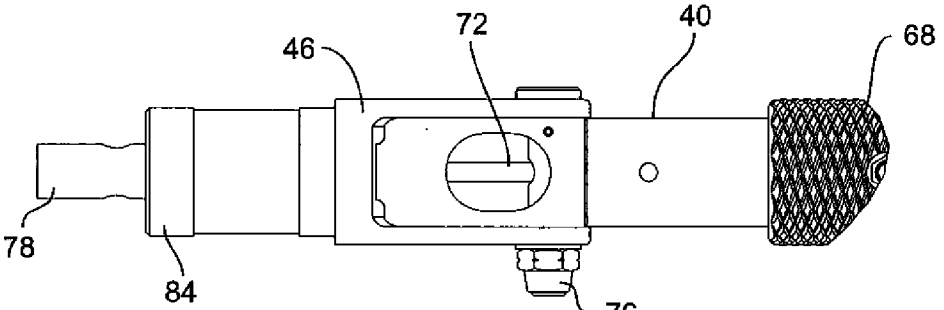
FIG. 5B is a partial side view of FIG. 5A.
Figure 5C:
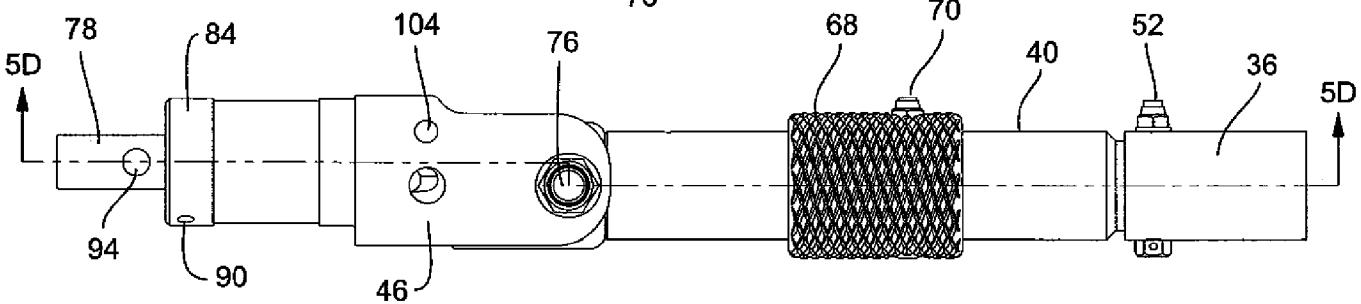
FIG. 5C is a bottom view of FIG. 5A
Figure 5D:
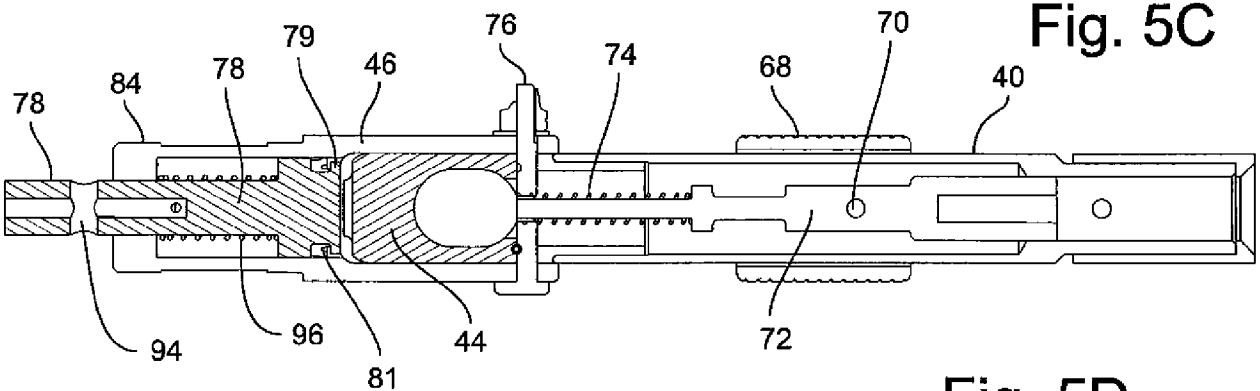
FIG. 5D is a sectional view along the line 5D-5D of FIG. 5C.
Figure 5E:
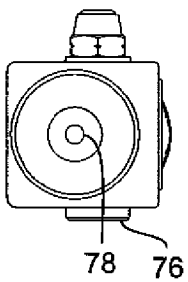
FIG. 5E is an end view of FIG. 5D.
Figures 6A, 6B, 6C, 6D:
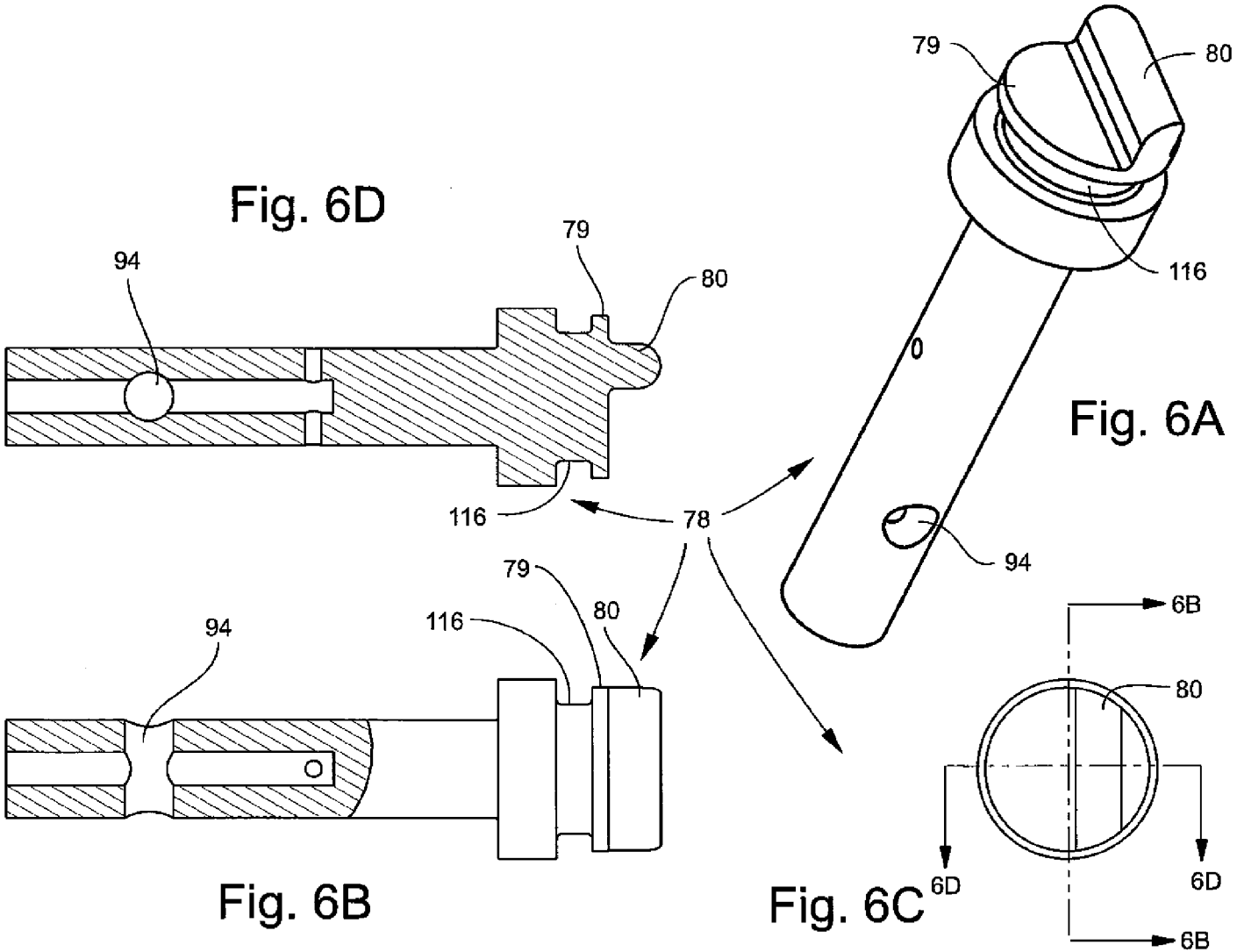
FIG. 6A is a perspective view of a locking plunger.
FIG. 6B is a sectional view along the line 6B-6B of FIG. 6C.
FIG. 6C is an end view of FIG. 6B.
FIG. 6D is a sectional view along the line 6D-6D of FIG. 6C.

In the locked position of FIG. 5D, an end 82 (FIGS. 7A and 7C) of lock release 72 abuts protrusion 80 of plunger 78. When locking sleeve 68 is moved to the left in FIG. 5D, end 82 of lock release 72 forces protrusion 80 out of locking groove 54 (FIG. 4A). As bar 40 is rotated with respect to bar 42, protrusion 80 slides down angled surface 58 (FIGS. 4A-E) of pivot and lock structure 44. From the locked position shown in FIG. 5D, rotation of bar 40 with respect to bar 42 may be limited to only one direction by blocker 62 (FIGS. 4A-E). Rotation in the opposite, undesired direction is prevented because blocker 62 abuts a circular protrusion support 79 (FIGS. 6A-D) of plunger 78. A seal 81 (FIG. 5D) to prevent entry of debris around plunger 78 may be placed in a groove 116 (FIG. 6B) formed behind circular protrusion support 79.

Figure 8A:
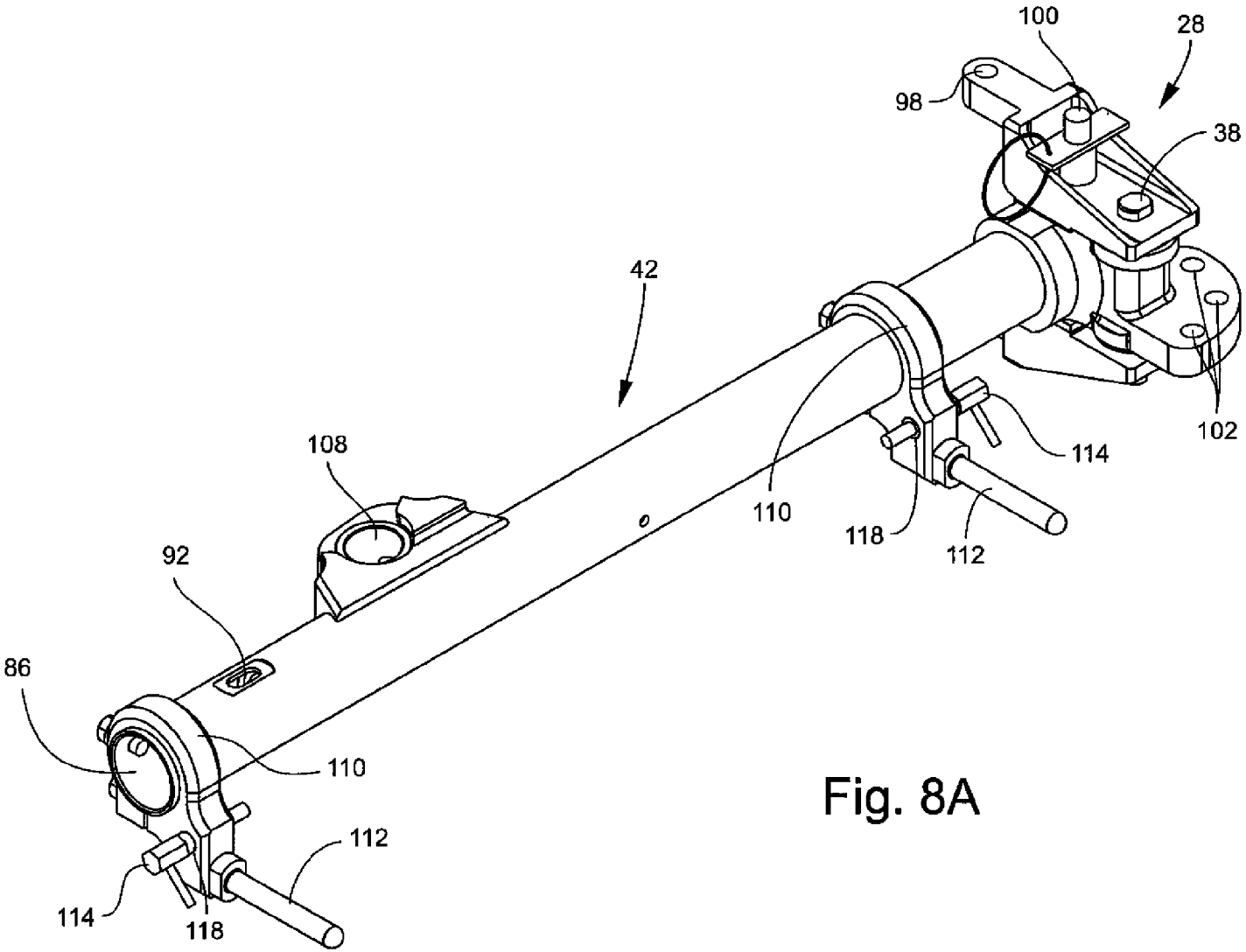
FIG. 8A is a perspective view of a second tubular bar shown in FIG. 1.
Figure 8B:
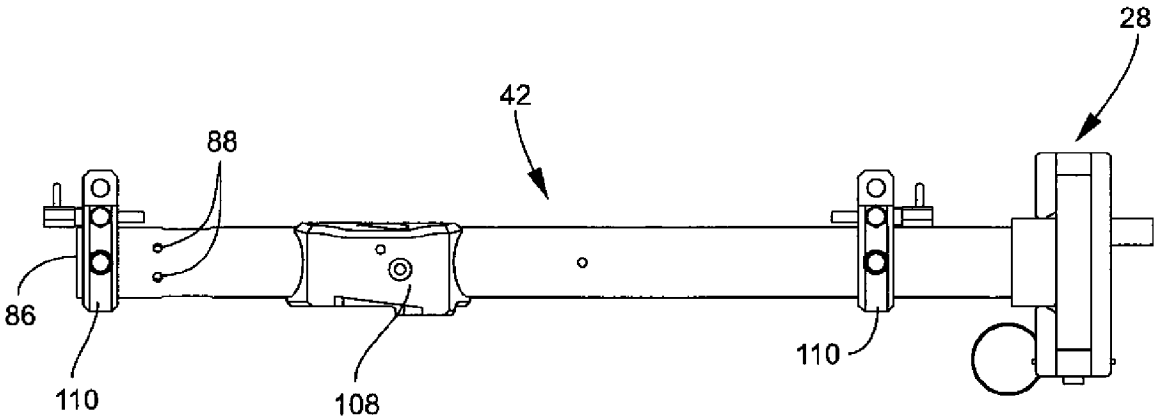
FIG. 8B is a bottom view of FIG. 8A.
Figure 8C:
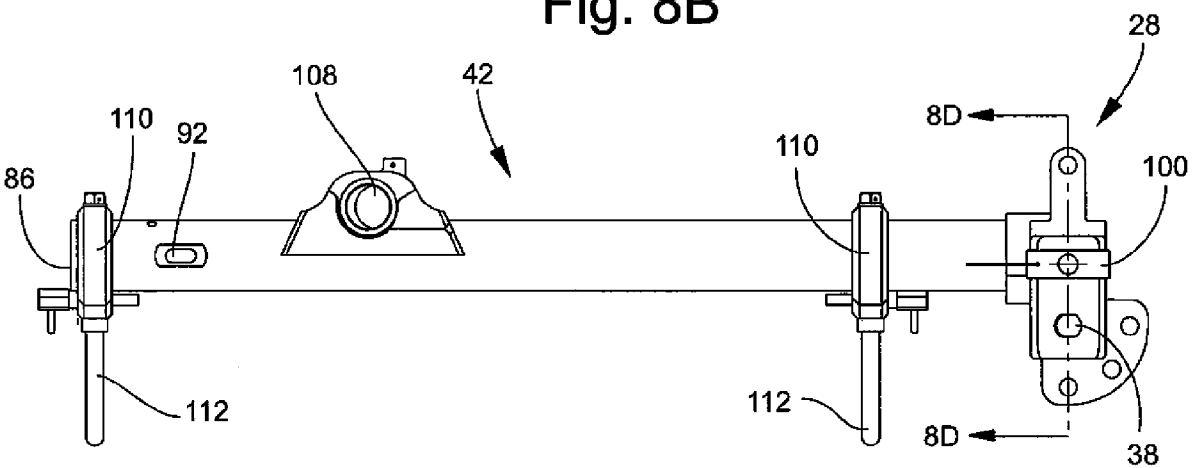
FIG. 8C is a top view of FIG. 8A.
Figure 8D:
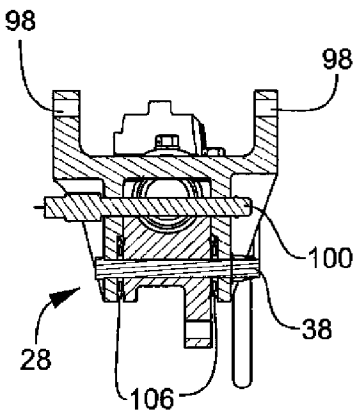
FIG. 8D is a sectional view along the line 8D-8D of FIG. 8C.

The end of plunger 78 opposite protrusion 80 may be supported in bar 42. A portion of bar 42 is shown in FIGS. 5A-E. The remainder of bar 42 is shown in FIGS. 8A-C. A male end 84 (FIG. 5A) of bar 42 may be pressed into a female end 86 (FIG. 8A) of bar 42 and further secured therein with screw type fasteners disposed in openings 88 (FIG. 8B) in female end 86 and openings 90 (FIG. 5C) in male end 84. As shown in FIG. 8A, bar 42 may include a slot 92 formed therein. Another slot 92, not visible in FIG. 8A, may be formed on the opposite side of tubular bar 42. Spring-loaded locking plunger 78 may include a transverse opening 94 (FIG. 5D). A fastener (not shown), similar to fastener 52 of FIG. 5A, may be translatably disposed in slots 92 in bar 42 and disposed in transverse opening 94 of spring-loaded locking plunger 78. A compression spring 96 (FIG. 5D) may be used to bias plunger 78 in the locked position.

As shown in FIGS. 8A-D, hinge assembly 28 may be fixed to an end of bar 42. Openings 98 in assembly 28 may accommodate mounting pin 30 (FIG. 1). The axis pin 38 defines the axis of rotation of mount 10. A safety pin 100 may be used to lock mount 10 in the position shown in FIG. 8A, or in various positions of rotation corresponding respectively to the plurality of pin openings 102 in assembly 28. In FIG. 8A, pin 100 is inserted in an opening 102 that is not visible in FIG. 8A. A similar safety pin 100 may be inserted in openings 104 (FIGS. 5A and 5C) in yoke 46 and openings 64 (FIG. 4A) in pivot and lock assembly 44 to prevent rotation of bar 40 with respect to bar 42, if locking plunger 78 were to fail. To aid in rotating arm assembly 26, thrust bearings 106 (FIG. 8D) may be used in hinge assembly 28.

Figure 2:
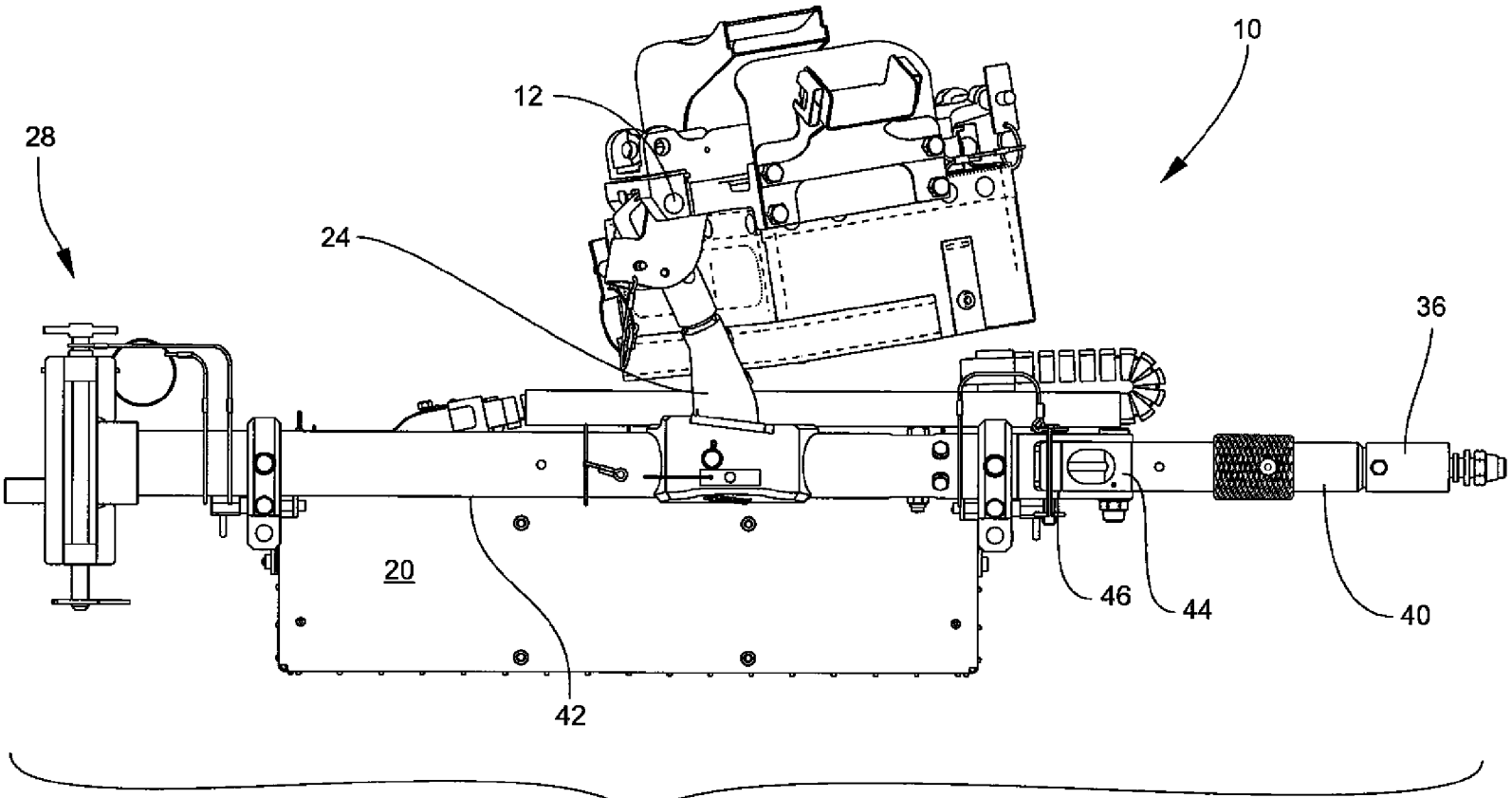
FIG. 2 is a side view of FIG. 1 from the opposite side.
Figure 9A:
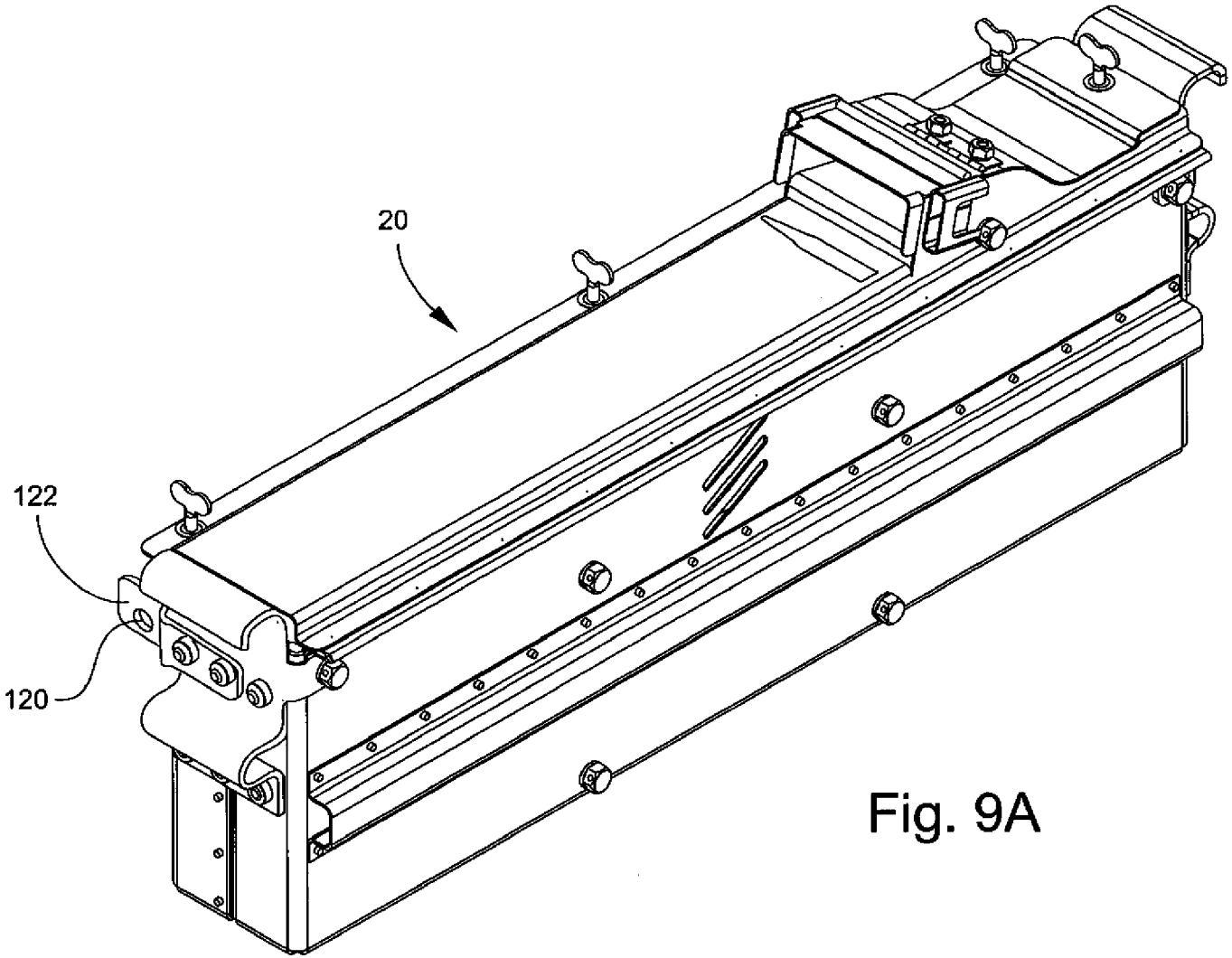
FIG. 9A is a perspective view of a bar-mounted ammunition container.

Referring to FIGS. 8A-C, a pintle socket 108 may be fixed to bar 42 for receiving pintle 24 (FIG. 2). A pair of spaced apart clamps 110 may be fixed to bar 42. Clamps 110 may include can pins 112 for supporting the bar-mounted ammunition container 20 (FIG. 1). Spring plungers 114 (FIG. 8A) may be inserted in openings 118 in clamps 110 and openings 120 (FIG. 9A) in tabs 122 (FIG. 9A) on each end of bar-mounted container 20.

Figures 9B, 9C:
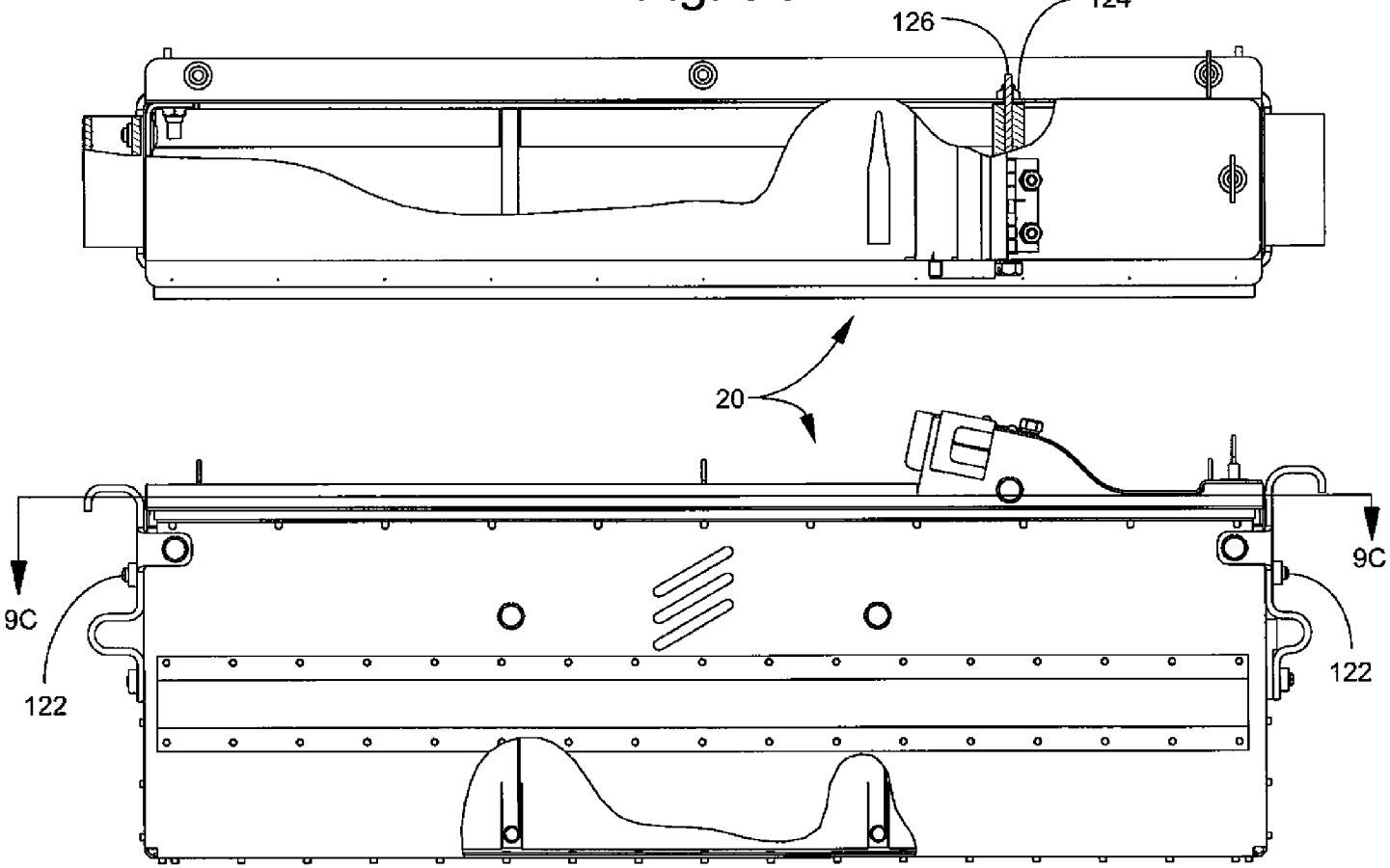
FIG. 9B is a partially cut away side view of FIG. 9A.
FIG. 9C is a sectional view along the line 9C-9C of FIG. 9B.

As seen in FIG. 9C, container 20 may include a roller 124 made of, for example, nylon or plastic. Roller 124 may rotate on a transversely mounted shaft 126. When using belted ammunition with conventional open face links, one side of the belt is "open" to the brass cartridges of the ammunition and the other side of the belt is primarily the steel links. In an ammunition container such as container 20, the ammunition belt may feed so that the steel side of the belt contacts the roller 124. If roller 124 were a metal roller, it would be prone to excessive wear. The rotating roller 124 made of a material such as plastic or nylon may greatly reduce wear.

Figure 10:
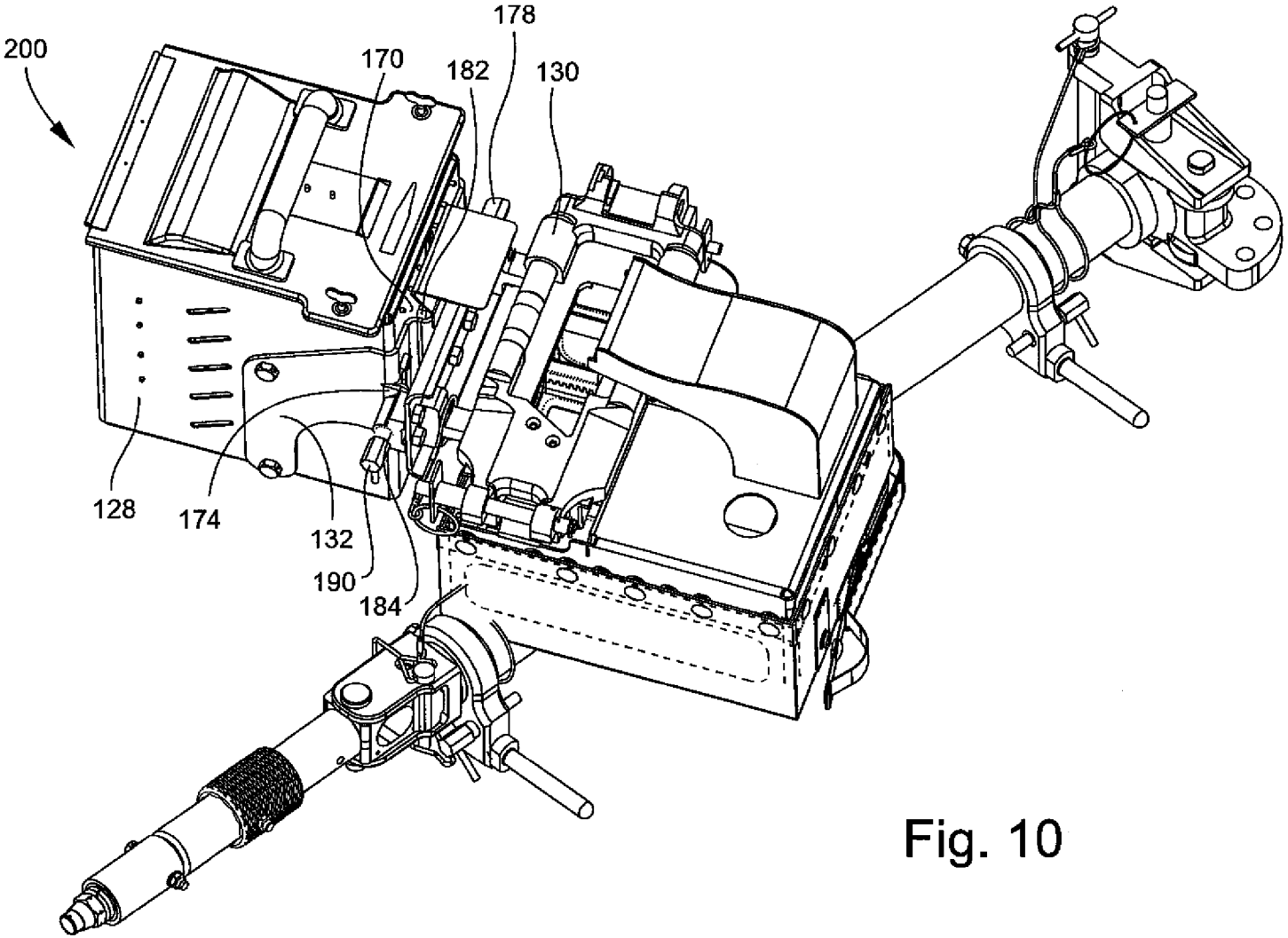
FIG. 10 is a perspective view of another embodiment of a gun mount.

FIG. 10 is a perspective view of another embodiment of a gun mount 200. Mount 200 is very similar to mount 10 except that bar-mounted ammunition container 20 is replaced with a cradle-mounted ammunition container 128. A gun cradle 130 of mount 200 may be a modified form of gun cradle 12 of mount 10 to thereby effectively interface with container 128.

Figure 11A:
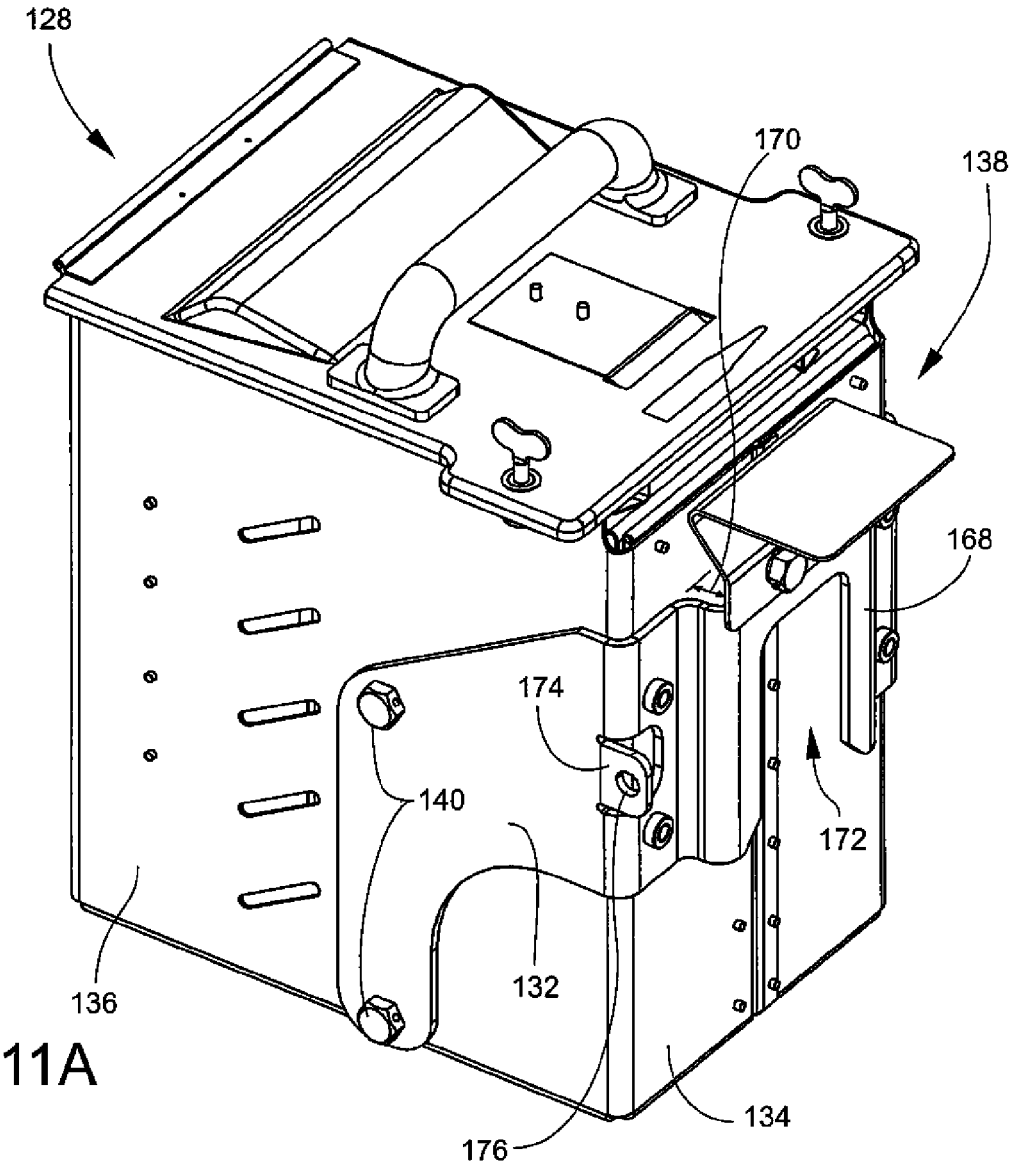
FIG. 11A is a perspective view of a cradle-mounted ammunition container.

FIG. 11A is a perspective view of cradle-mounted ammunition container 128. Container 128 may be made of, for example, aluminum. A novel mounting bracket 132 may extend across a front wall 134 and two opposing sides walls 136, 138 of container 128. Bracket 132 may be made of, for example, steel. Bracket 132 provides mechanical strength and support to aluminum container 128. Bracket bolts 140 may extend completely through container 128 from side wall 136 to side wall 138. Bolts 140 also provide support for interior partitions of container 128.

The portion of bracket 132 at front wall 134 may include a protruding portion 168 that defines a gap 170 between front wall 134 and portion 168. Protruding portion 168 may include an opening 172. Opening 172 may be generally shaped like an inverted U. An ear 174 may project forward from mounting bracket 132 at the corner of front wall 134 and side wall 136. Ear 174 may include an opening 176 therein.

Figure 12A:
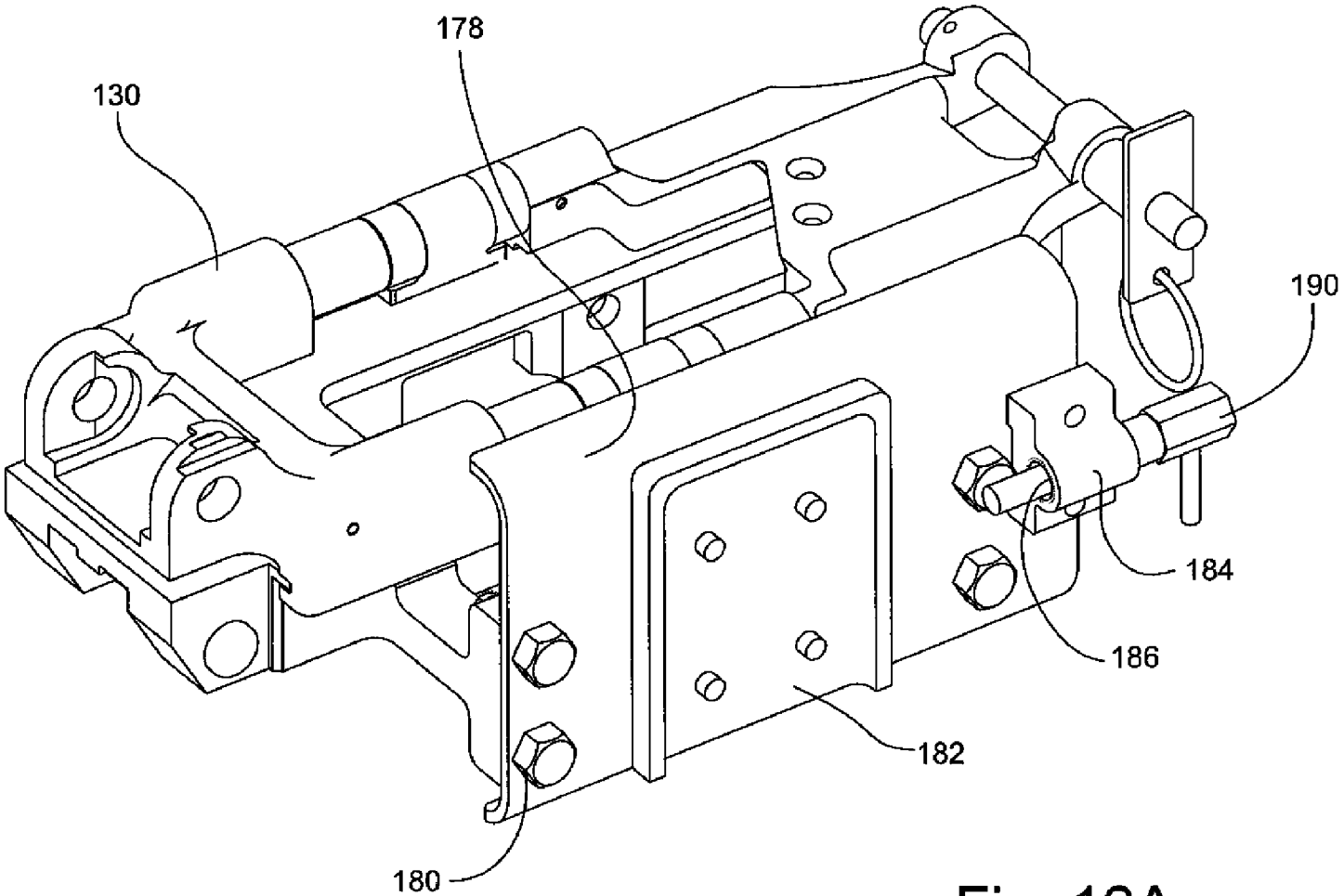
FIG. 12A is a perspective view of the gun cradle of FIG. 10 showing an arrangement for mounting an ammunition container.
Figure 12B:
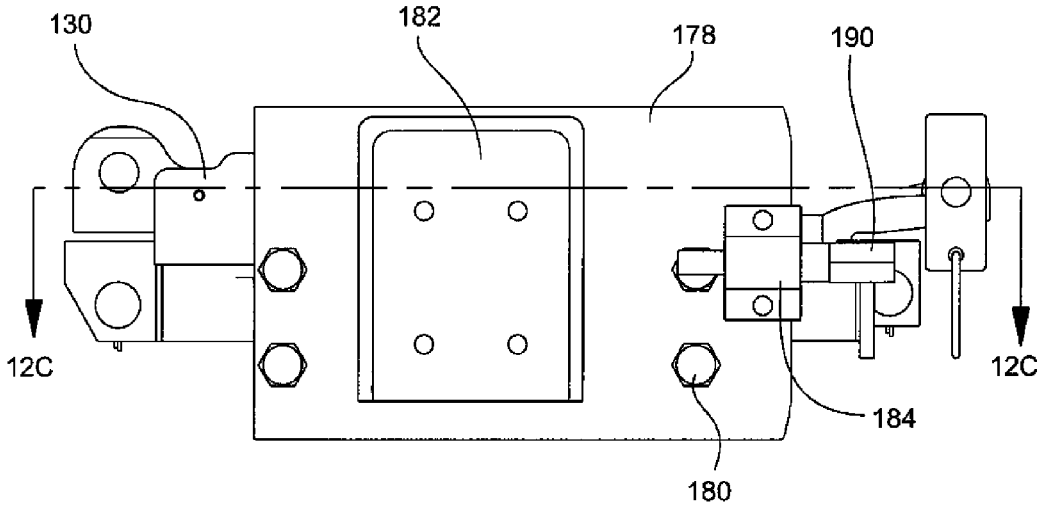
FIG. 12B is a side view of FIG. 12A.
Figure 12C:
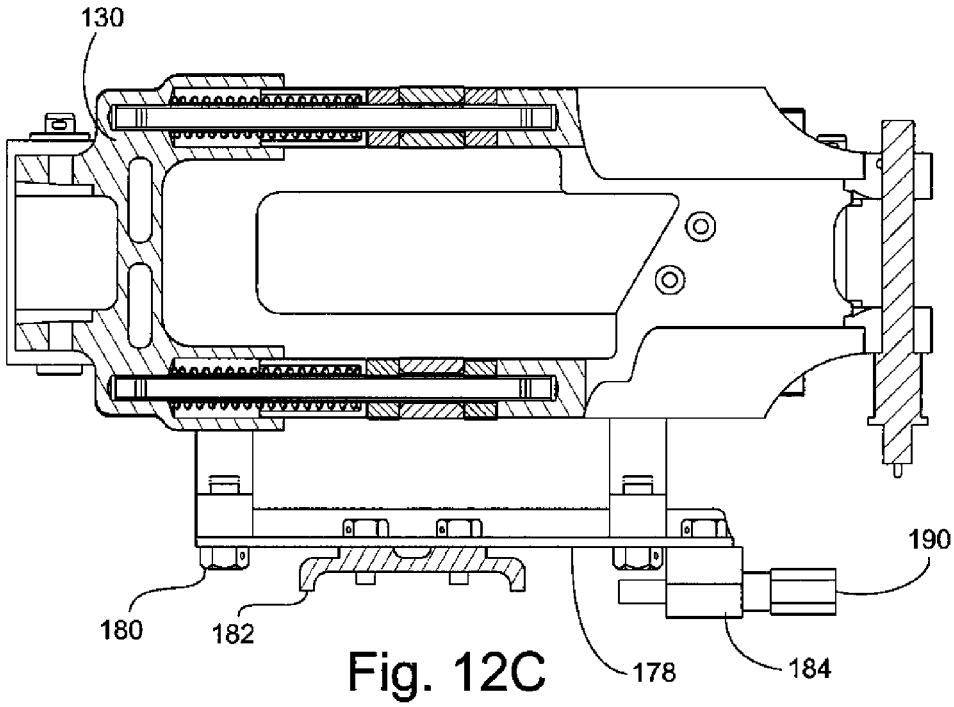
FIG. 12C is a sectional view taken along the line 12C-12C of FIG. 12B.
Figure 13A:
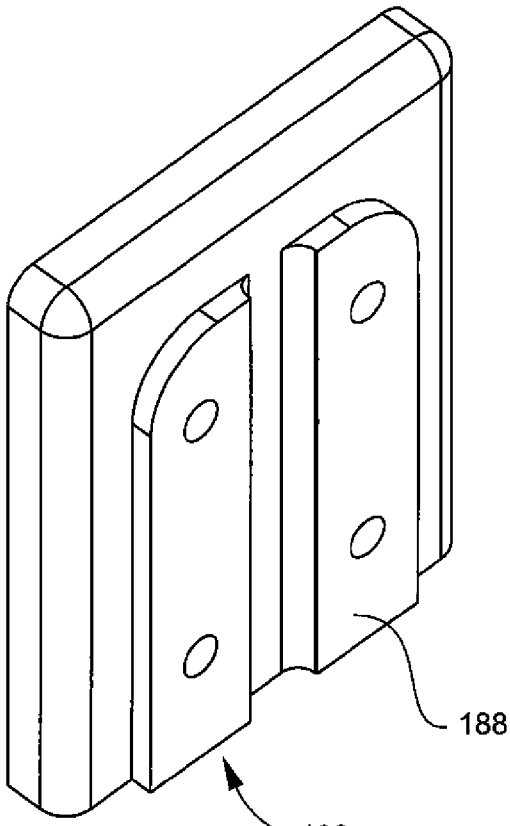
FIG. 13A is a perspective view of the mounting plate shown in FIG. 12A.
Figure 13B:
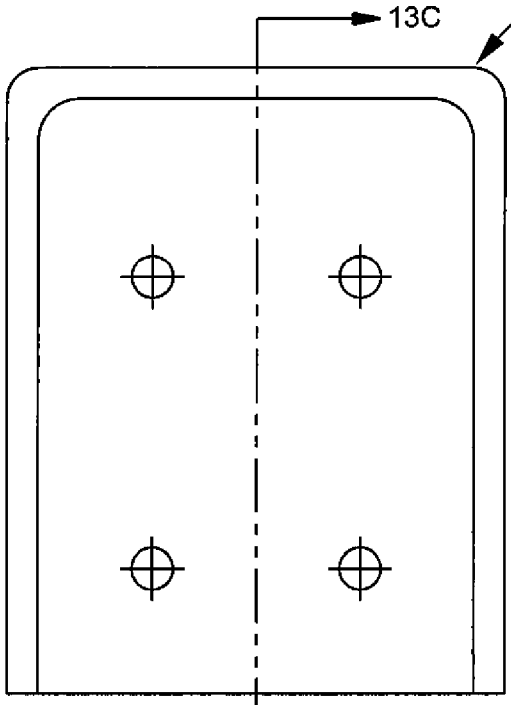
FIG. 13B is a side view of the opposite side of FIG. 13A.
Figure 13C:
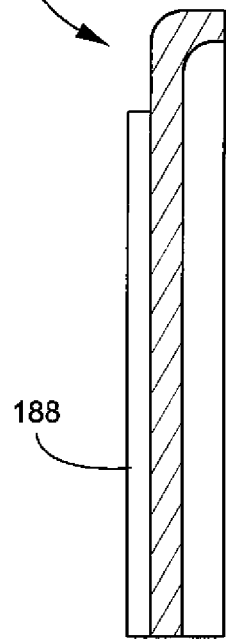
FIG. 13C is a sectional view taken along the line 13C-13C of FIG. 13B.

As shown in FIGS. 12A-C, a second mounting bracket 178 may be fixed to gun cradle 130 using, for example, bolts 180. A mounting plate 182 may be fixed to second mounting bracket 178. A lug 184 having a through-hole 186 may be fixed to second mounting bracket 178. A locking plunger 190 may be staked to through-hole 186 in lug 184. Referring to FIGS. 13A-13C, mounting plate 182 may include a raised portion 188 having a generally inverted U shape.

Ammunition container 128 (FIG. 10) may be fixed to gun cradle 130 by inserting mounting plate 182 into gap 170 between front wall 134 of ammunition container 128 and protruding portion 168 of mounting bracket 132 such that generally inverted U shape opening 172 of mounting bracket 132 mates with generally inverted U shape raised portion 188 of mounting plate 182. Furthermore, ammunition container 128 may be additionally fixed to gun cradle 130 by inserting locking plunger 190 through opening 176 in ear 174 (FIG. 11A) that extends from mounting bracket 132 of ammunition container 128.

Figure 11C:
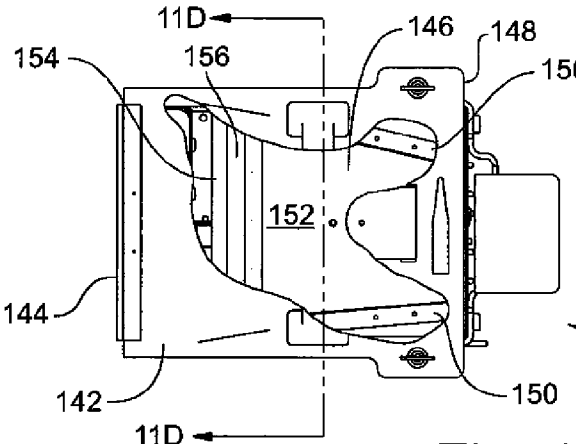
FIG. 11C is a partially cut away, sectional view along the line 11C-11C of FIG. 11B.
Figure 11B:
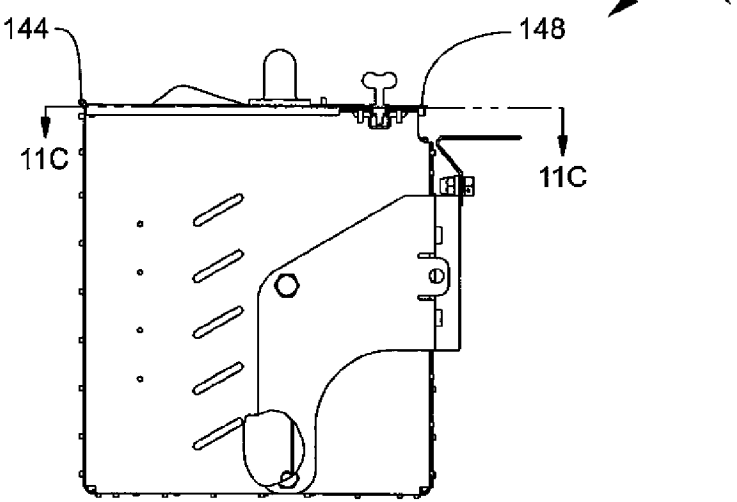
FIG. 11B is a side view, partially cut away, of FIG. 11A.
Figure 11D:
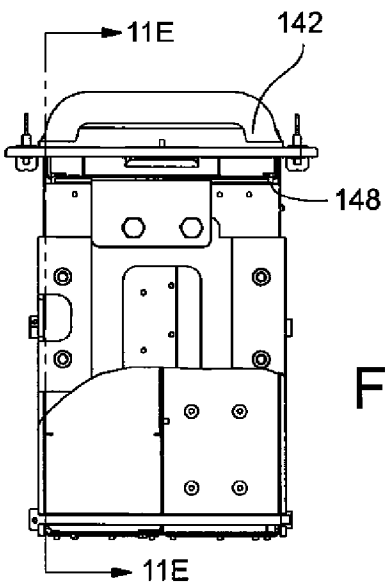
FIG. 11D is a partially cut away, sectional view along the line 11D-11D of FIG. 11C.

As shown in FIG. 11C, container 128 may include a lid 142 hinged at end 144. Beneath lid 142 may be a generally planar feed tray 146. Feed tray 146 may be hinged at opposite end 148 of container 128. Feed tray 146 may include a pair of tray guides 150 that define a tapered feed area 152. A non-rotating roller 156 may be disposed at the wide end 154 of feed area 152. Non-rotating roller 156 may have a curved exterior surface to aid in feeding ammunition belts from the interior partitions of container 128 to feed tray 146. Because roller 156 may be non-rotating, it may not be prone to jamming that may occur when foreign matter accumulates around a rotating roller. Roller 156 and feed tray 146 may be made of, for example, steel.

When using belted ammunition with conventional open face links, one side of the belt is "open" to the brass cartridges of the ammunition and the other side of the belt is primarily the steel links. In an ammunition container such as container 128, the ammunition belt may feed so that the open side (i.e., the brass cartridges) of the belt contacts roller 156. Repeated contact of the brass cartridge surfaces on steel roller 156 may cause less deterioration of roller 156 than if the primarily steel side of the ammunition belt were to repeatedly contact roller 156.

Figures 11E, 11F, 11G:
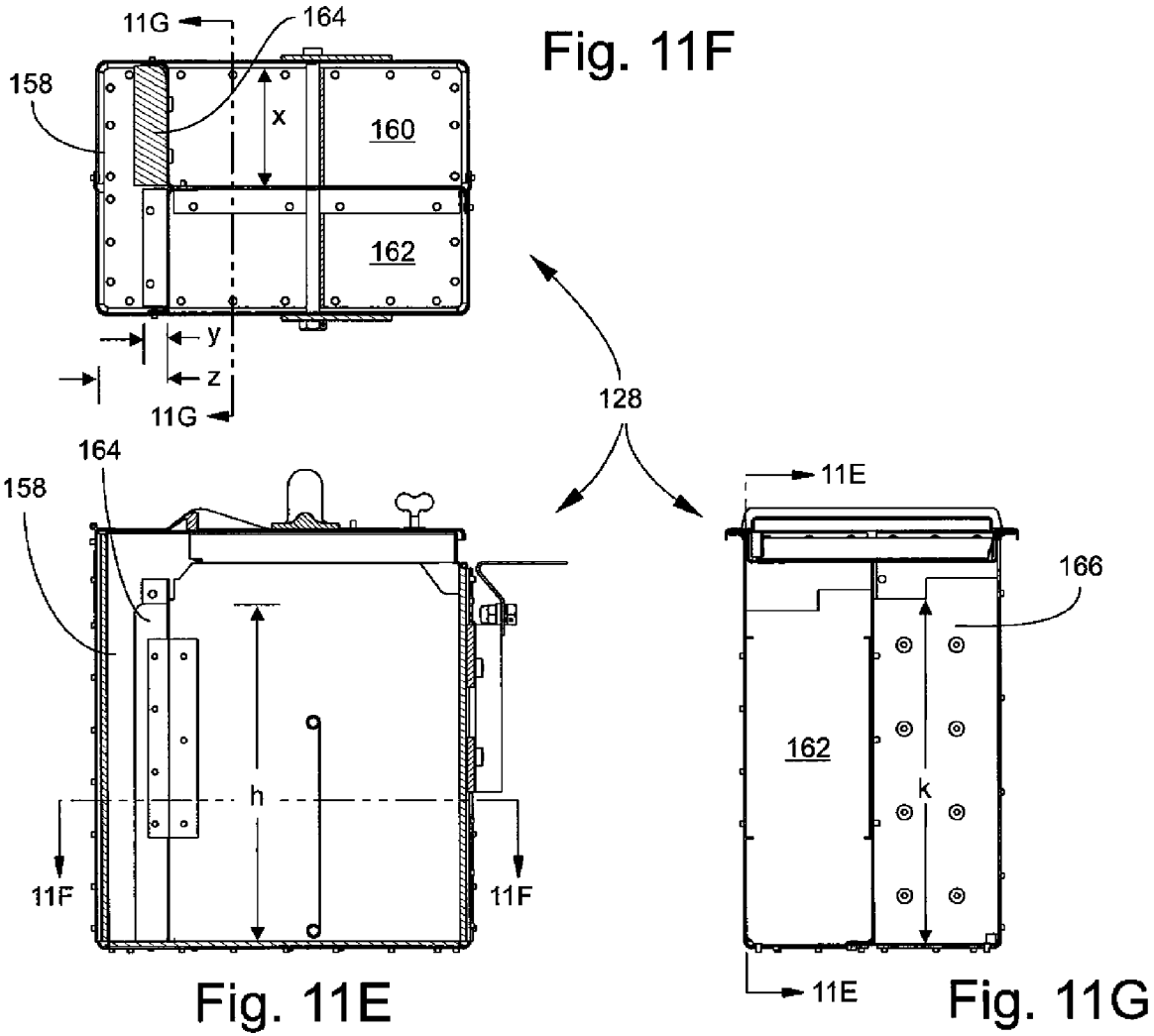
FIG. 11E is a sectional view along the line 11E-11E of FIG. 11D.
FIG. 11F is a sectional view along the line 11F-11F of FIG. 11E.
FIG. 11G is a sectional view along the line 11G-11G of FIG. 11F.

Referring to FIGS. 11E-11G, cradle-mounted ammunition container 128 may include a cross-over compartment 158 that spans two ammunition storage compartments 160, 162. Cross-over compartment 158 may include a filler block 164. Filler block 164 may be made of, for example, aluminum. Block 164 may have a transverse dimension x that may be about the same width as compartment 160 of container 128. Block 164 may have an axial dimension y that may be about one-half the axial extent z of cross-over compartment 158. Block 164 may have a height or vertical dimension h that may be about the same as a vertical dimension k of partition 166 between cross-over compartment 158 and compartment 160. Filler block 164 may help prevent the cross-over portion of the ammunition belt located in cross-over compartment 158 from binding and jamming up.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A mount for a gun, comprising:

a generally tubular bar having a pivot and lock structure on one end, the bar including a pair of slots formed on opposing sides of the bar;

a locking sleeve slidable on the bar;

a fastener fixed to the locking sleeve and translatable in the pair of slots in the bar;

a second generally tubular bar having a yoke at one end and a hinge assembly at another end, the yoke being rotatably engaged with the pivot and lock structure;

the pivot and lock structure including a locking groove and an angled surface having one edge at the locking groove, the angled surface sloping inwardly from the one edge toward another end of the generally tubular bar;

a spring-loaded locking plunger translatably disposed in the yoke and having a protrusion that is selectively engagable with the locking groove; and a spring-loaded lock release translatably disposed in the generally tubular bar and engaged with the fastener wherein the protrusion of the locking plunger is disengaged from the locking groove of the pivot and lock structure by translation of the spring-loaded lock release, and, further comprising a pintle socket fixed to the second generally tubular bar, and, further comprising a pintle and a gun cradle, the pintle having one end disposed in the pintle socket and the other end fixed to the gun cradle, and further comprising an ammunition container supported by the gun cradle.

2. The mount of claim 1, wherein the ammunition container includes a mounting bracket that extends around a front wall and two side walls of the ammunition container.

3. The mount of claim 2, further comprising bolts that secure the mounting bracket to the ammunition container and support interior partitions of the ammunition container.

4. The mount of claim 1, wherein the ammunition container includes a lid and a feed tray, the lid and the feed tray being hinged at opposite ends of the ammunition container.

5. The mount of claim 4, wherein the feed tray includes a tapered feed area defined by a pair of tray guides and further wherein a wider end of the tapered feed area includes a non-rotating metal roller.

6. The mount of claim 1, wherein the ammunition container includes a cross-over compartment adjacent first and second ammunition storage compartments, the cross-over compartment including a filler block having a transverse dimension about the same as a transverse dimension of one of the first and second ammunition storage compartments and an axial dimension about the same as one-half an axial extent of the cross-over compartment.

7. The mount of claim 6, wherein the filler block has a height about the same as a height of a partition between the cross-over compartment and one of the first and second ammunition storage compartments.

8. The mount of claim 2, wherein the mounting bracket includes a protruding portion that defines a gap between the front wall of the ammunition container and the protruding portion.

9. The mount of claim 8, wherein the protruding portion of the mounting bracket includes an opening having a generally inverted U shape.

10. The mount of claim 9, further comprising a second mounting bracket fixed to the gun cradle, a mounting plate fixed to the second mounting bracket, and a lug with a through-hole fixed to the second mounting bracket.

11. The mount of claim 10, wherein the mounting plate includes a raised portion having a generally inverted U shape.

12. The mount of claim 11, wherein the ammunition container is fixed to the gun cradle by inserting the mounting plate into the gap between the front wall of the ammunition container and the protruding portion of the mounting bracket such that the generally inverted U shape opening of the mounting bracket mates with the generally inverted U shape raised portion of the mounting plate.

13. The mount of claim 12, wherein the ammunition container is fixed to the gun cradle by inserting a locking plunger staked to the through-hole in the lug through an opening in an ear that extends from the mounting bracket of the ammunition container.

* * * * *